United States Patent [19]

Mazzini

[11] Patent Number: 4,526,212

[45] Date of Patent: Jul. 2, 1985

[54] ACTUATING DEVICE FOR RECIPROCATING GRIPPERS IN SHUTTLELESS LOOMS

[75] Inventor: Mazzino Mazzini, Agliana, Italy

[73] Assignee: Alamak SA, Luxembourg, Luxembourg

[21] Appl. No.: 380,803

[22] Filed: May 21, 1982

Related U.S. Application Data

[63] Continuation-in-part of Ser. No. 139,497, Apr. 11, 1980, Pat. No. 4,338,974.

[51] Int. Cl.[3] ..... D03D 47/00

[52] U.S. Cl. ..... 139/449

[58] Field of Search ..... 139/440, 441, 444, 445, 139/446, 449

[56] References Cited

FOREIGN PATENT DOCUMENTS

| | | | |
|---|---|---|---|
| 504677 | 8/1951 | Belgium | 139/449 |
| 261587 | 6/1913 | Fed. Rep. of Germany | 139/449 |
| 2628067 | 1/1977 | Fed. Rep. of Germany | 139/449 |
| 672399 | 10/1964 | Italy | 139/449 |
| 2073789 | 10/1981 | United Kingdom | 139/449 |
| 2099862 | 12/1982 | United Kingdom | 139/449 |

*Primary Examiner*—Henry S. Jaudon

*Attorney, Agent, or Firm*—Guido Modiano; Albert Josif

[57] ABSTRACT

Actuating device for the reciprocating movement of the belts carrying the weft thread insertion grippers in shuttleless looms. Each belt is provided with a lengthwise series of slots and with the slots of one series a respective gear wheel is in mesh engagement. An oscillating gear sector drives the gear wheel. The gear sector has along a radial line thereof a slotted link coupling including a runner. The coupling provides articulation both with the big end of a connecting rod in a crank mechanism, which is driven by a cyclic shaft of the shuttleless loom, and with the pin of a rocker arm following the oscillations of the gear sector. The law of motion determined by the cooperation of the slotted link coupling and the runner causes variation of the transmitted speed, acceleration and stroke, particularly near the two dead points of oscillation of the sector thereby improving the operations of the grippers to which such motion is transmitted.

1 Claim, 5 Drawing Figures

ACTUATING DEVICE FOR RECIPROCATING GRIPPERS IN SHUTTLELESS LOOMS

This is a continuation in part of patent application Ser. No. 06/139,497 filed on Apr. 11, 1980, now U.S. Pat. No. 4,338,974.

BACKGROUND OF THE INVENTION

This invention relates generally to shuttleless looms with reciprocating weft inserting grippers and in particular to an actuating mechanism for such weft inserting grippers.

As is known, in shuttleless looms, the weft thread is inserted by means of two suitably designed grippers (sometimes called needles or darts, depending on their different shapes). During the long standstill phase of the comb and related opening of the shed, the two grippers, which are carried cantilever-fashion by the respective sides of the loom, are first moved toward each other, starting from such sides, and then, after meeting at the center of the loom and handing over the weft thread, returned to the loom sides to allow the comb beating up.

Also known are shuttleless looms wherein each such gripper is secured at one end to a respective flexible belt, arranged to slide in a sort of arcuate guide. The two arcuate guides extend in a horizontal plane lying parallel to the loom front and project out of said sides, and sometimes depend downwards from the loom, such as not to interfere with the oscillations of the sley to which the comb is mounted. Moreover, each belt is provided with a lengthwise series of slots, in mesh engagement with the teeth of a respective gear or toothed wheel which is driven to reciprocate rotatively in either direction, thereby the belt is moved out of the guide and the related gripper is brought to the loom center, and viceversa, the belt is withdrawn and the gripper moved back.

Numerous are the aspects of the types of control utilized in the past for such gear wheels which have failed to prove fully satisfactory. For example, with the currently employed controls, the belts of the weft inserting grippers do not have sufficiently low speeds and accelerations to ensure, at the gripper travel limit corresponding to the loom center, a correct transfer of the weft thread from one gripper to the other. Furthermore the bulk size of the looms is considerable, and so are the travel sections covered by the grippers during their return stroke after leaving the reed.

Other drawbacks are due to the conventional controls being less than entirely suitable for application to looms having, within a certain range, a front of different useful extension.

This invention sets out to obviate the cited shortcomings.

SUMMARY OF THE INVENTION

According to one aspect of the present invention, there is provided an actuating device for the reciprocating movement of the transmission systems carrying the weft thread inssertion grippers in shuttleless looms, wherein each transmission system is driven by a respective gear wheel, characterized in that it comprises between at least one of said gear wheels and a connecting rod and crank assembly driven by a cyclic shaft of the shuttleless loom, an oscillating gear sector, driving said gear wheel, said gear sector having substantially along a radial line thereof a movable coupling including a runner said coupling providing articulation both with an end of a linkage member of said connecting rod and crank assembly and with a pin of a rocker arm following the oscillations of said gear sector, thereby to guide the movement of said linkage member end.

BRIEF DESCRIPTION OF THE DRAWINGS

Further features will be more clearly apparent from the description of a preferred, though not limitative, embodiment of this control, illustrated by way of example only in the accompanying drawings, where.

DESCRIPTION OF THE PREFERRED EMBODIMENTS

Figure 3:
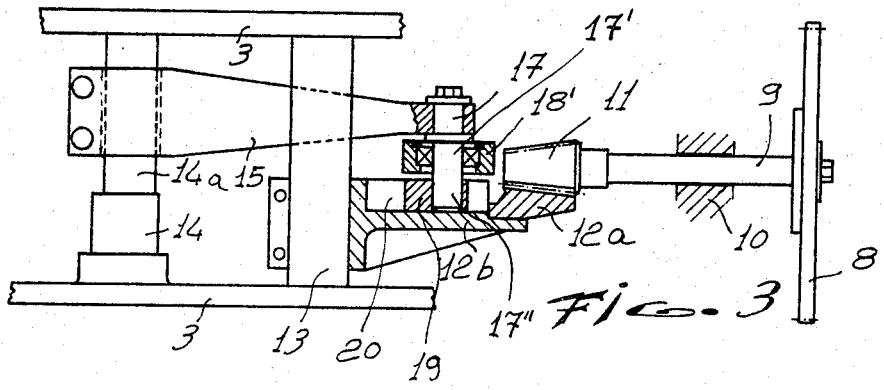
FIG. 3 is a partly sectional plan view of the control shown in FIG. 2, as taken along the line III—III of FIG. 2.

With reference to the drawing figures, the numeral 1 designates the reed of a shuttleless loom. A lower reinforcement 2 of the reed is attached to a sley, not shown, which can be oscillated, in a known manner, about a horizontal axis extending parallel to the loom front and being located between the two sides of the same. Parallel to each such side there extend a respective pair of vertical supporting elements 3, which are also connected to that side externally thereto.

On the front, the reinforcement 2 has a threshold 2*a*, which is covered by a special gasket and upon which two grippers 4 and 5 are arranged to slide, which grippers are attached each to the top end of a respective belt 6. The grippers 4 and 5 serve for inserting the weft thread; the gripper 4 can be, for example, the one intended for picking up the weft thread, or pulling gripper, whilst the gripper 5 can fulfill the function of inserting and deliver the weft thread to the preceding gripper.

The belts 6 are flexible and arranged for sliding in a sort of guides or sheathes 7, which extend in a common plane parallel to the loom front. Starting from its top end, contiguous to a respective end of the reed 1, each guide 7 has a rectilinear section or portion which, outside of the related loom side, extends downwards into an arcuate section or portion, which may be terminated with a lower or bottom rectilinear section facing the loom center.

The belts 6 are flattened horizontally, parallel to the loom sides. Each belt is provided with a lengthwise series of engagement formations or slots (symbolically indicated with reference numeral 6*a*), which are distributed at regular intervals. With the slots in one series, there mesh engages a gear or toothed wheel 8 which is keyed to one end of a related shaft 9. Each shaft 9 is carried pivotally by a bearing 10 which is laid horizontal and parallel to the vertical elements 3 in the proximity of the top end of the respective guide 7, through which passes the wheel 8 to mesh with the related belt 6.

At the end of each shaft 9 remote from the gear wheel 8, there is keyed a bevel pinion gear 11 which meshes with a portion of a bevel gear or gear rim segment 12*a*, secured to a sector 12*b*. Each toothed sector or gear segment 12*a–b* is journalled between the respective pair of vertical elements 3; it is, in fact, secured to a pin 13 which is carried pivotally by said vertical elements 3 and is perpendicular thereto. It will be understood that the pin 13 constitutes supporting means for pivotally supporting said gear sector 12*a*–12*b* and defines an axis of oscillation thereof.

The pair of vertical elements 3 also carries a second pin 14, parallel and coplanar with the pin 13 but located, with respect to the pin 13, on the side remote from the wheel 8. The second pin 14 acts as the pivot for a rocker arm 15. In particular, the second pin 14 has an eccentric portion 14*a* which acquires variable distance from the pin 13 depending on the angular position in which the second pin 14 is locked with respect to the vertical elements 3. With the interposition of a bushing, the rocker arm 15 is mounted pivotally to the portion 14*a*, thereby its pivot is at an adjustable distance from the portion 13 of the gear sector 12*a*–12*b*. It will thus be appreciated from the foregoing that the eccentric pivot portion 14*a* has an eccentric axis about which the rocker arm 15 actually rotates, while the pivot 14 has a main axis offset with respect of the eccentric axis about which the angular adjustment of the pin 14 is effected. As it appears from FIG. 2 the rocker arm 15 has an arcuated shape adapted to bypass the pin 13 thereby to avoid interference therewith during the oscillation of the rocker arm 15.

Pivotally connected to a first extension 17′ of the terminating pin 17 of the rocker arm 15 is the small end 18′ of a connecting rod 18 and to a further extension 17″ of the terminating pin 17, a slider 19, which is slot linked at 20 to the sector 12*b*, the slot link, i.e. the raceway forming the slot link 20, extending along the bisecting line 12*c* of said sector. It will be understood that the extensions 17′ and 17″ of the pin 17 constitute a linkage member with an articulation end for the connecting rod 18, the slider 19 and the rocker arm 15. Thus the rocker arm 15 follows the oscillations of the gear sector 12*a*–*b* in the same direction. The big end of the connecting rod 18 is articulated to a second pin 21 of a crank 22 which keyed to one end of a shaft 23. The shaft 23, extending parallel to the loom front and located between the sides of the same, is driven to complete one revolution per cycle of the loom. The crank mechanism or the connecting rod and crank assembly 22–18, located at the ends of the shaft 23 and being driven thereby, convert the rotary motion of the shaft 23 into a reciprocating movement of the respective gear sectors 12*a*–*b* and respective wheels 8, such that while one wheel turns in one direction the other turns in the opposite direction.

Figure 2:
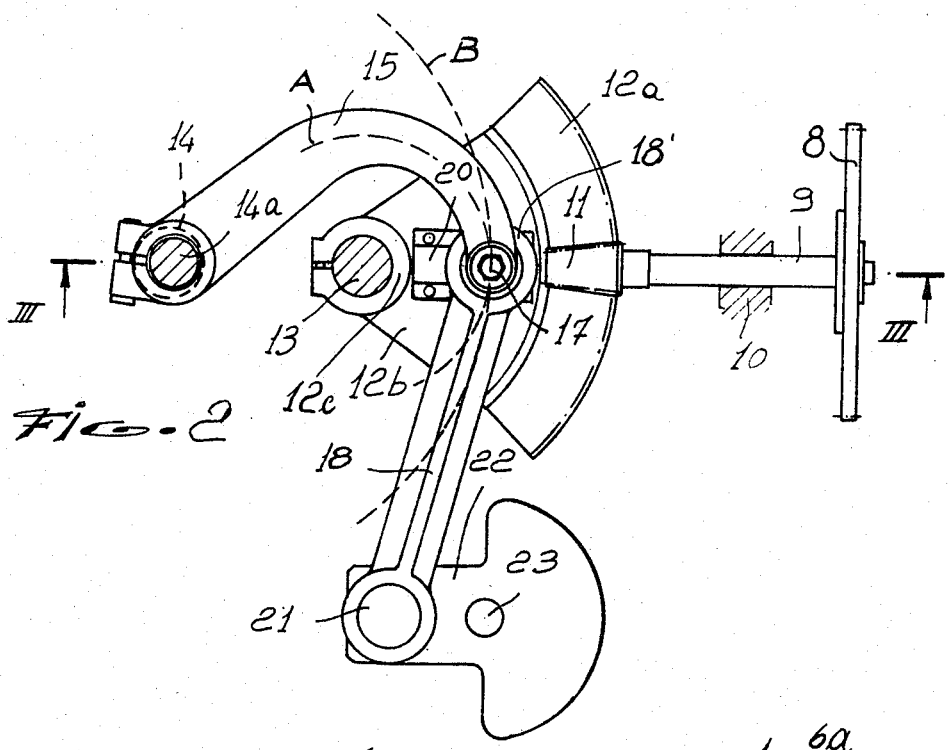
FIG. 2 is a detail view of a control according to this invention, as viewed from one side of the loom.

As it appears clearly from FIG. 2 of the drawing FIG. 2, the shaft 9 of the toothed wheel 8 intersects the axis of oscillation 13 of the gear sector 12*a*–12*b*.

Furthermore as it appears clear from FIG. 2 the crank 22 is arranged laterally at a distance from the gear sector 12*a*–12*b* so that there is always a significant angle between the rocker arm 15 and the connecting rod 18.

The control described in the foregoing operates as follows.

When the reed 1 is at a standstill in the position where its lower reinforcement is aligned with the top sections of the guides 7, the belts 6 are controlled to move out of the same and insert the grippers 4 and 5 through the warp thread shed. The grippers reach as far as the center of the loom, and the gripper 5 delivers the weft thread to the gripper 4. At this stage, the wheels 8 reverse their rotations and control the belts 6 to move back into the guides 7, thereby the grippers are withdrawn. As the grippers withdraw from the reed 2, the reed rapidily completes its oscillation to beat in the weft inserted in the fabric and then returns to its condition in alignment with the top sections of the guides 7. The simultaneous engagement of the slotted link 20 of the sector 12*b* by the rocker arm 15 and conrod 18 of the crank mechanism, as driven by the cyclic shaft 23, produces the aforesaid favourable laws of motion of the grippers 4 and 5 at their end of stroke positions, respectively at the center and sides of the loom.

It should be observed that these favourable laws of motion are determined by the fact that, whereas in the position indicated in FIG. 2 of the pin 17 a material point of the sector 12*b* lying at the considered moment on the axis of the pin 17 is moved subsequently along a path coinciding with the circular arc A the radius of which converges towards the center of the pin 13, instead the pin 17 itself is moved subsequently to the considered moment along a path coinciding with the circular arc B the radius of which converges towards the center of the pivot 14*a* and is therefore greater than the radius of the circular arc A. Consequently near the two dead points of the oscillation of the sector 12*b* the law of motion is determined by the greater radius of the circular arc B so that on the one hand there is obtained a reduction of the stroke of the grippers, which otherwise would have been greater, and on the other side a variation of the speed and of the accelerations is obtained during the stroke, which variations favour the gripping and the releasing action of the weft performed by the grippers.

It should be further noted that the adjustment of the angular position of the pin 14, and accordingly of the distance of the pivot 14*a* of the rocker arm 15 from the pivot 13 of the gear sector 12*a*–*b*, affords the possibility of using one and the same control even though the useful width of the loom may vary within limits.

Figure 1:
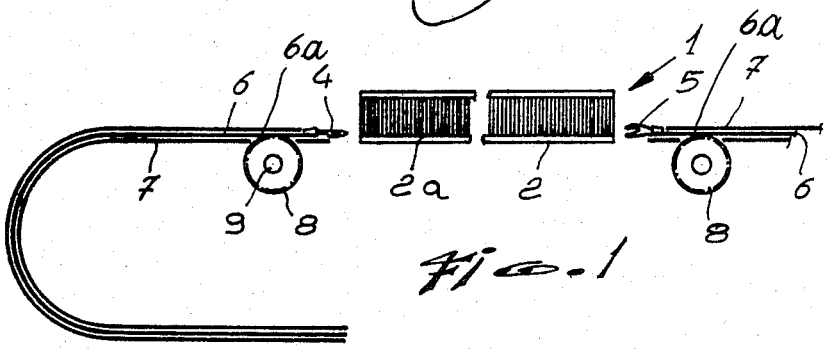
FIG. 1 is a diagrammatical partial front view of a shuttleless loom.
Figure 4:
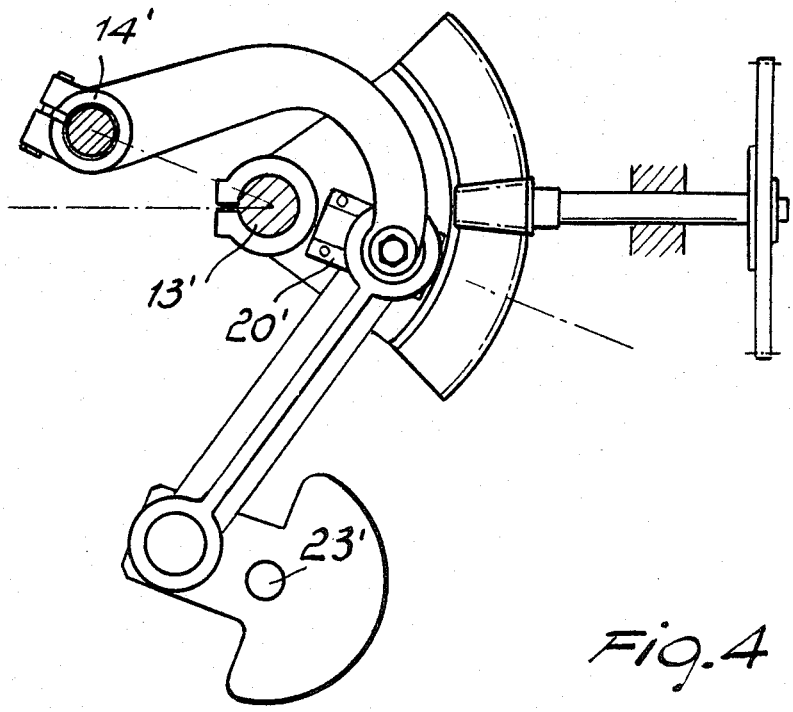
FIG. 4 shows a first modified embodiment.

In the embodiment shown in FIG. 4, which otherwise corresponds to the embodiment of FIGS. 1–3, the raceway 20′ is angularly displaced from the bisector line and the pivot 14′ and the drive shaft 23′ are angularly displaced by the same amount about the centre of the shaft 13′, as compared to the location of these members in the embodiment shown in FIGS. 1–3. With such a modified arrangement of the component members of the shown device the acceleration and deceleration rates at each end of the stroke remain unchanged, so that the operation of the device also remains unchanged.

Figure 5:
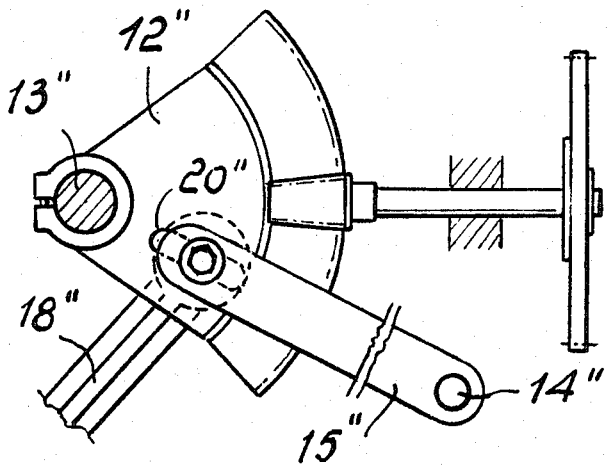
FIG. 5 shows a second modified embodiment.

In the embodiment shown in FIG. 5, which otherwise corresponds to the embodiment of FIGS. 1–3, the pivot 14″ of the rocker arm 15″ is arranged in front of the gear sector 12″, while the raceway 20″ is again angularly displaced with respect of the bisector line of the sector 12″.

It will be further appreciated that the stud 17 need not to be fixed in the rocker arm 15 but need merely locate in it.

It will be further appreciated that instead of a slider 19 a runner or roller may be adopted, which would roll rather than slide along the guide slot 20.

Thus, the invention as described achieved its objects.

In practicing the invention, all of the details may be replaced with other technically equivalent ones without departing from the invention's scope.

I claim:

1. An actuating device for reciprocating weft thread insertion grippers of a shuttleless loom, comprising a rocker arm having articulation means on one end thereof and pivot means on the other end thereof, a crank at a distance from said articulation means and driven by a cyclic shaft of the shuttleless loom, a connecting rod having one extremity thereof in articulation engagement with said articulation means and having another extremity thereof hingedly connected with said crank, an oscillating gear sector member having shaft means for pivotally supporting it and defining an axis of oscillation thereof, said gear sector having a radial line, a single raceway on said gear sector member and extending along said radial line, a runner movable within said single raceway, linkage means for hingedly connecting said runner with said one extremity of connecting rod and said articulation means of said rocker arm and a transmission system for converting the oscillating motion of said gear sector member into the reciprocating motion of said thread insertion grippers, wherein said shaft means of said sector member are arranged in a position intermediate said articulation means and said pivot means.

* * * * *